US012735249B2

(12) United States Patent
Barker

(10) Patent No.: US 12,735,249 B2
(45) Date of Patent: Sep. 15, 2026

(54) SLIDE GATE CLOSURE

(71) Applicant: Alexander Barker, Red Deer (CA)

(72) Inventor: Alexander Barker, Red Deer (CA)

( * ) Notice: Subject to any disclaimer, the term of this patent is extended or adjusted under 35 U.S.C. 154(b) by 0 days.

(21) Appl. No.: 19/045,647

(22) Filed: Feb. 5, 2025

(65) Prior Publication Data

US 2026/0225797 A1 Aug. 6, 2026

(51) Int. Cl.

| | |
|---|---|
| ***B65D 90/58*** | (2006.01) |
| ***B65D 88/02*** | (2006.01) |
| ***B65D 88/28*** | (2006.01) |
| ***B65D 90/66*** | (2006.01) |

(52) U.S. Cl.

CPC ..... *B65D 90/587* (2013.01); *B65D 88/02* (2013.01); *B65D 88/28* (2013.01); *B65D 90/66* (2013.01); *B65D 2588/02* (2013.01); *B65D 2588/54* (2013.01); *B65D 2590/662* (2013.01)

(58) Field of Classification Search

CPC ..... B65D 90/587; B65D 88/02; B65D 88/28; B65D 88/54; B65D 90/66

USPC ..... 220/890, 262, 260, 812, 813

See application file for complete search history.

(56) References Cited

U.S. PATENT DOCUMENTS 890,940 A * 6/1908 Lehman ..... C10J 1/213 48/80
1,109,723 A * 9/1914 White ..... E06B 3/4663 312/319.9
1,732,271 A * 10/1929 Krumm ..... B65B 67/02 222/533
3,938,861 A * 2/1976 Bagwell ..... B61D 7/20 105/247
4,073,410 A * 2/1978 Melcher ..... E02D 17/12 222/181.3
4,136,804 A * 1/1979 Kinzler ..... B65D 90/60 222/506
4,691,957 A * 9/1987 Ellingson ..... B60J 7/085 220/314
4,838,598 A * 6/1989 Hyde ..... B60P 1/26 222/561
4,998,640 A * 3/1991 Edelhoff ..... B65F 3/143 220/262

(Continued)

FOREIGN PATENT DOCUMENTS

CN 108891803 A * 11/2018 ..... B65D 90/66
CN 109335351 A * 2/2019 ..... B65D 88/28

*Primary Examiner* — Orlando E Aviles
*Assistant Examiner* — Niki M Eloshway
(74) *Attorney, Agent, or Firm* — Lewellyn Law, PLLC; Stephen Lewellyn

(57) ABSTRACT

A slide gate closure has a frame that is adapted to be mounted to a bottom of a bottom discharge container over the discharge opening at the bottom of the container. A slide gate is slidably mounted to the frame such that the slide gate is configured to move selectively between a closed position, in which the slide gate fully covers the discharge opening, and an open position, in which the slide gate does not fully cover the discharge opening. The slide gate closure further has a lever and a linkage that operatively connects the slide gate and the lever such that operating the lever in a first direction causes the slide gate to move in direction toward the open position and operating the lever in a second direction causes the slide gate to move in a direction toward the closed position.

10 Claims, 8 Drawing Sheets

(56) References Cited

U.S. PATENT DOCUMENTS

| | | | | |
|---|---|---|---|---|
| 5,934,731 | A * | 8/1999 | Routledge | B60J 5/108 74/105 |
| 7,445,419 | B2 * | 11/2008 | Andersen | B60P 1/56 414/810 |
| 11,365,047 | B1 * | 6/2022 | Mohns | B65D 90/587 |
| 2020/0109005 | A1 * | 4/2020 | Garmendia | B65D 88/30 |
| 2021/0023975 | A1 * | 1/2021 | Friesen | B60P 1/56 |
| 2021/0138952 | A1 * | 5/2021 | Petrillo, Sr. | B60P 3/225 |

* cited by examiner

SLIDE GATE CLOSURE

FIELD OF THE INVENTION

The present invention generally relates to closures and, more particularly, to a slide gate closure for a bottom discharge container for storing and transporting bulk material.

BACKGROUND OF THE INVENTION

Bulk storage containers are widely used in industries such as agriculture, manufacturing, and material handling to store and dispense granular or powdered materials. These containers often feature bottom discharge openings to facilitate controlled material flow during unloading.

To regulate material discharge, slide gate closures are commonly employed. Traditional slide gate mechanisms typically consist of a movable gate that slides horizontally across an opening to either restrict or allow material flow. However, existing designs often suffer from drawbacks such as inefficient sealing, difficulty in operation, material clogging, or wear over time due to repeated use in demanding environments.

There is a need for an improved slide gate closure that enhances operational efficiency, provides a reliable seal to prevent leakage, and ensures smooth, controlled discharge of materials from bottom discharge bins. The present invention addresses these challenges by offering an improved slide gate closure with enhanced durability, ease of use, and improved material flow control.

SUMMARY OF THE INVENTION

The present disclosure provides a new and innovative slide gate closure for a bottom discharge container. In an example, the slide gate closure has a frame that is adapted to be mounted to a bottom of a bottom discharge container over the discharge opening at the bottom of the container. A slide gate is slidably mounted to the frame such that the slide gate is configured to move selectively between a closed position, in which the slide gate fully covers the discharge opening, and an open position, in which the slide gate does not fully cover the discharge opening. The slide gate closure further has a lever and a linkage that operatively connects the slide gate and the lever such that operating the lever in a first direction causes the slide gate to move in direction toward the open position and operating the lever in a second direction causes the slide gate to move in a direction toward the closed position.

In another example, the slide gate closure has a frame. The frame defines an inlet opening on one side and defines an outlet opening on a side opposite of the inlet opening. The frame adapted to be mounted to a bottom of the container with the inlet opening aligned with the discharge opening of the container. The frame further has a pair of slide rails located on opposite sides of the outlet opening. A slide gate is slidably supported by the slide rails such that the slide gate is configured to move selectively between a closed position, in which the slide gate fully covers the discharge opening, and an open position, in which the slide gate does not fully cover the discharge opening. The slide gate closure further has a lever this is pivotally mounted at one end thereof to a fixed structure and with the opposite end of the lever being free such that the lever is rotatable relative to the fixed structure. A linkage operatively connects the slide gate and the lever such that rotating the lever in a first direction causes the slide gate to move in direction toward the open position and rotating the lever in a second direction causes the slide gate to move in a direction toward the closed position.

In further aspects, the linkage may have a connecting rod that is connected at one end thereof to the lever and is operatively connected at an opposite end thereof to the slide gate.

In further aspects, the linkage may have a first hinge plate and a second hinge plate that are connected for relative rotation therebetween, and the first hinge plate may further be connected to the slide gate and the second hinge plate may further be connected to the connecting rod.

In further aspects, the first hinge plate may be hingedly connected to the slide gate at one end of the hinge plate and may be hingedly connected to the second hinge plate at a second end of the hinge plate that is opposite of its first end.

In further aspects, the second hinge plate may be hingedly connected at one end to the frame and may be hingedly connected at a second end to the hinge plate.

In further aspects, the frame may have supporting structure extending outwardly from a side of the frame and wherein the second hinge plate may be hingedly connected at the one end to the supporting structure. The supporting structure may include a pair of spaced apart flanges between which the second hinge plate is disposed.

Additional features and advantages of the disclosed apparatus are described in, and will be apparent from, the following Detailed Description and the Figures. The features and advantages described herein are not all-inclusive and, in particular, many additional features and advantages will be apparent to one of ordinary skill in the art in view of the figures and description. Moreover, it should be noted that the language used in the specification has been principally selected for readability and instructional purposes, and not to limit the scope of the inventive subject matter, unless stated otherwise.

BRIEF DESCRIPTION OF THE DRAWINGS

A further understanding of the nature and advantages of the present disclosure may be realized by reference to the following drawings. In the appended figures, similar components or features may have the same reference label. Further, various components of the same type may be distinguished by following the reference label by a dash and a second label that distinguishes among the similar components. If just the first reference label is used in the specification, the description is applicable to any one of the similar components having the same first reference label irrespective of the second reference label. No attempt is made to show structural details of the embodiments in more detail than is necessary for a fundamental understanding of the invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized, and changes can be made without departing from the scope of the disclosure.

Figure 1:
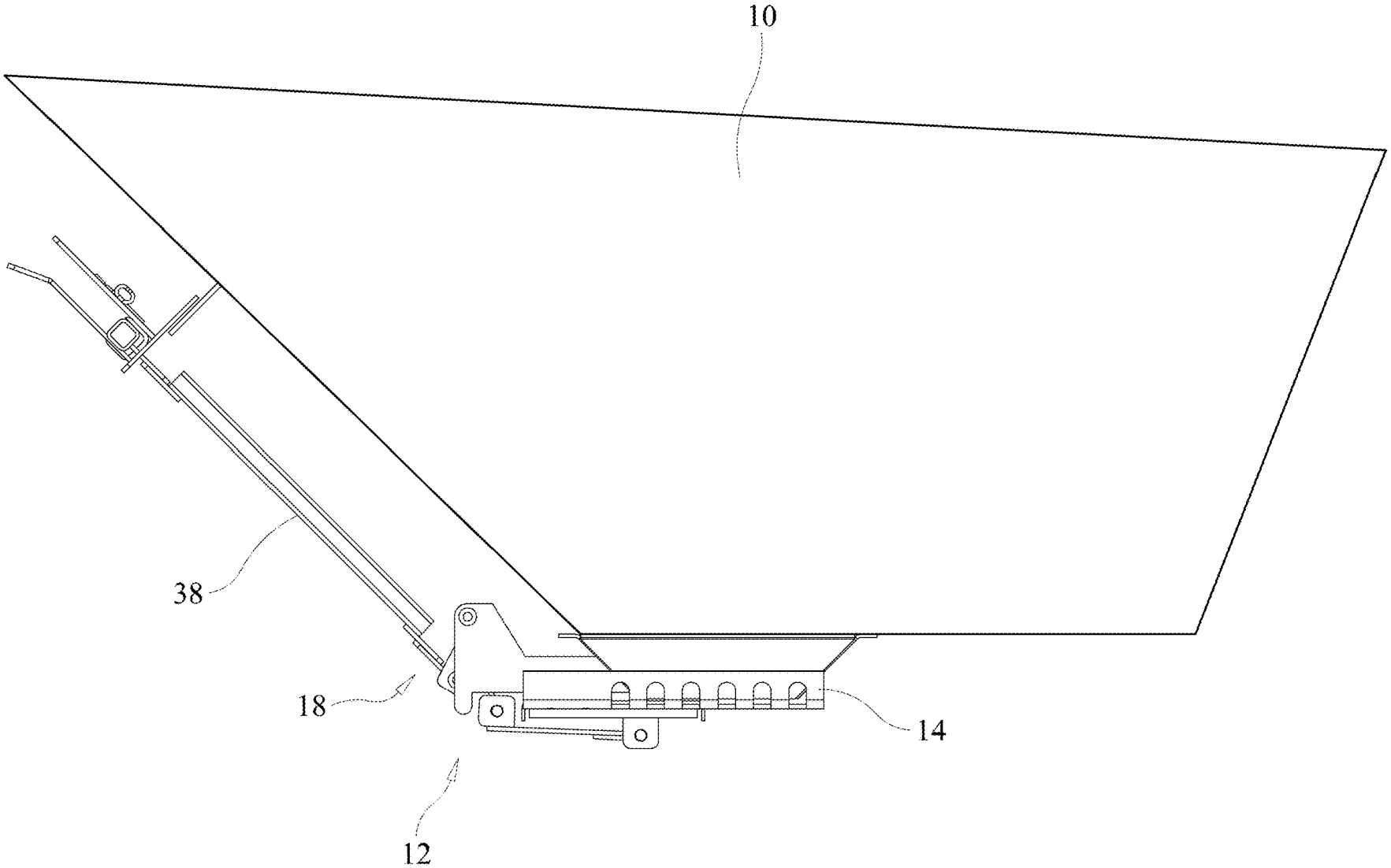
FIG. 1 illustrates a side view of a slide gate closure mounted to a bottom discharge container, according to an aspect of the present disclosure.
Figure 2:
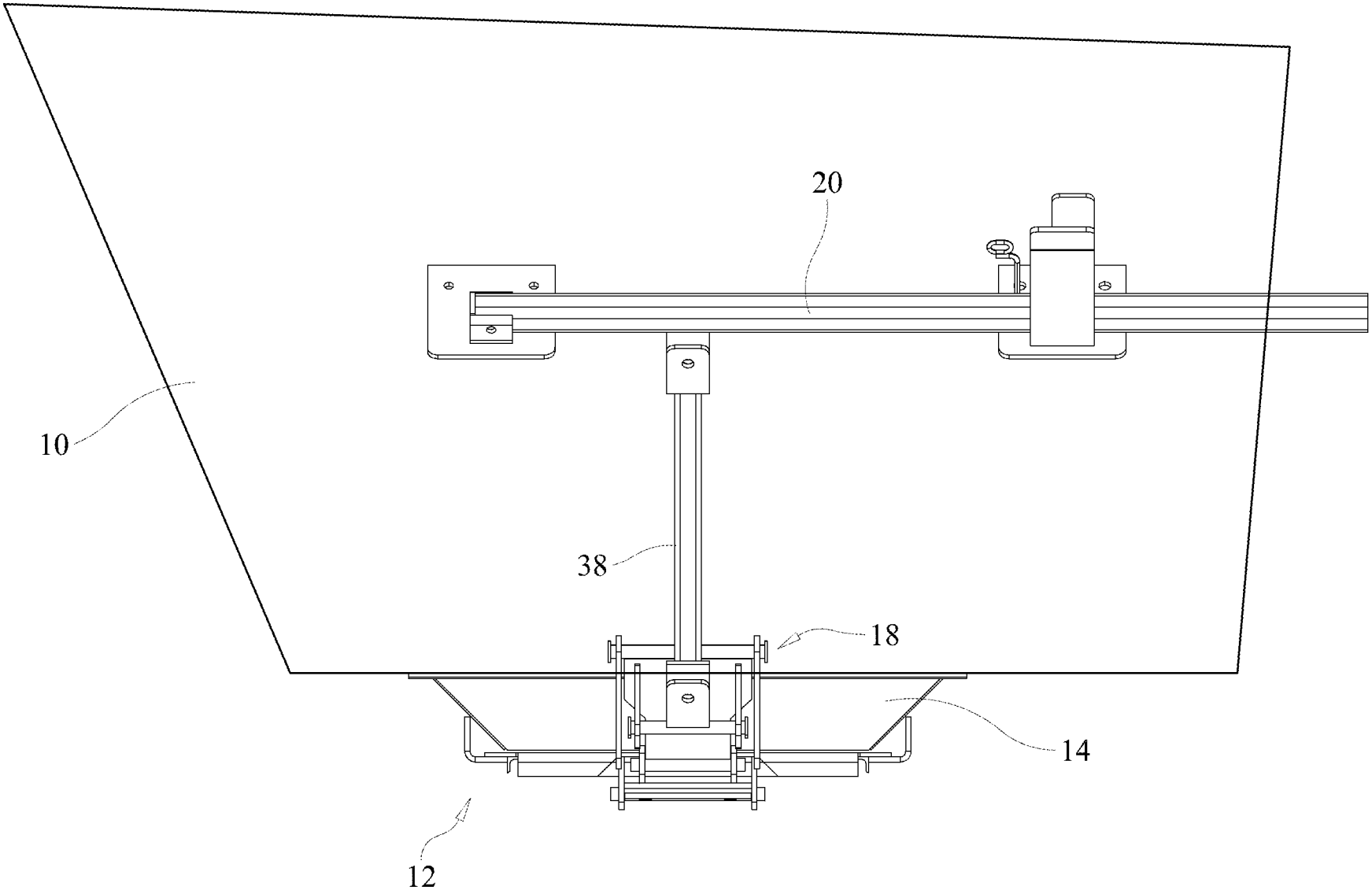
FIG. 2 illustrates a front view of a slide gate closure mounted to a bottom discharge container, according to an aspect of the present disclosure.
Figure 3:
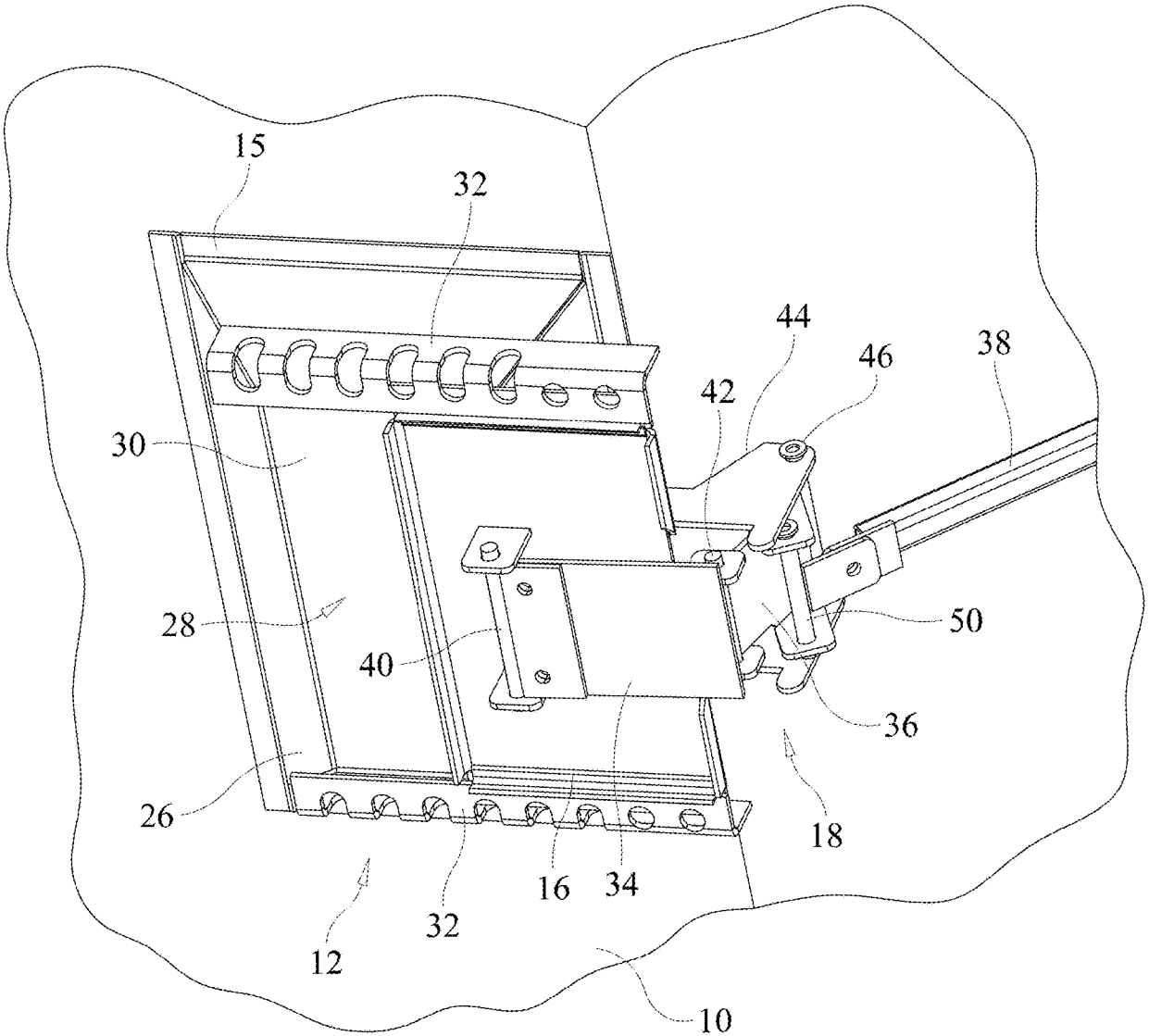
FIG. 3 illustrates a bottom perspective view of a slide gate closure mounted to a bottom of a bottom discharge container, according to an aspect of the present disclosure.
Figure 4:
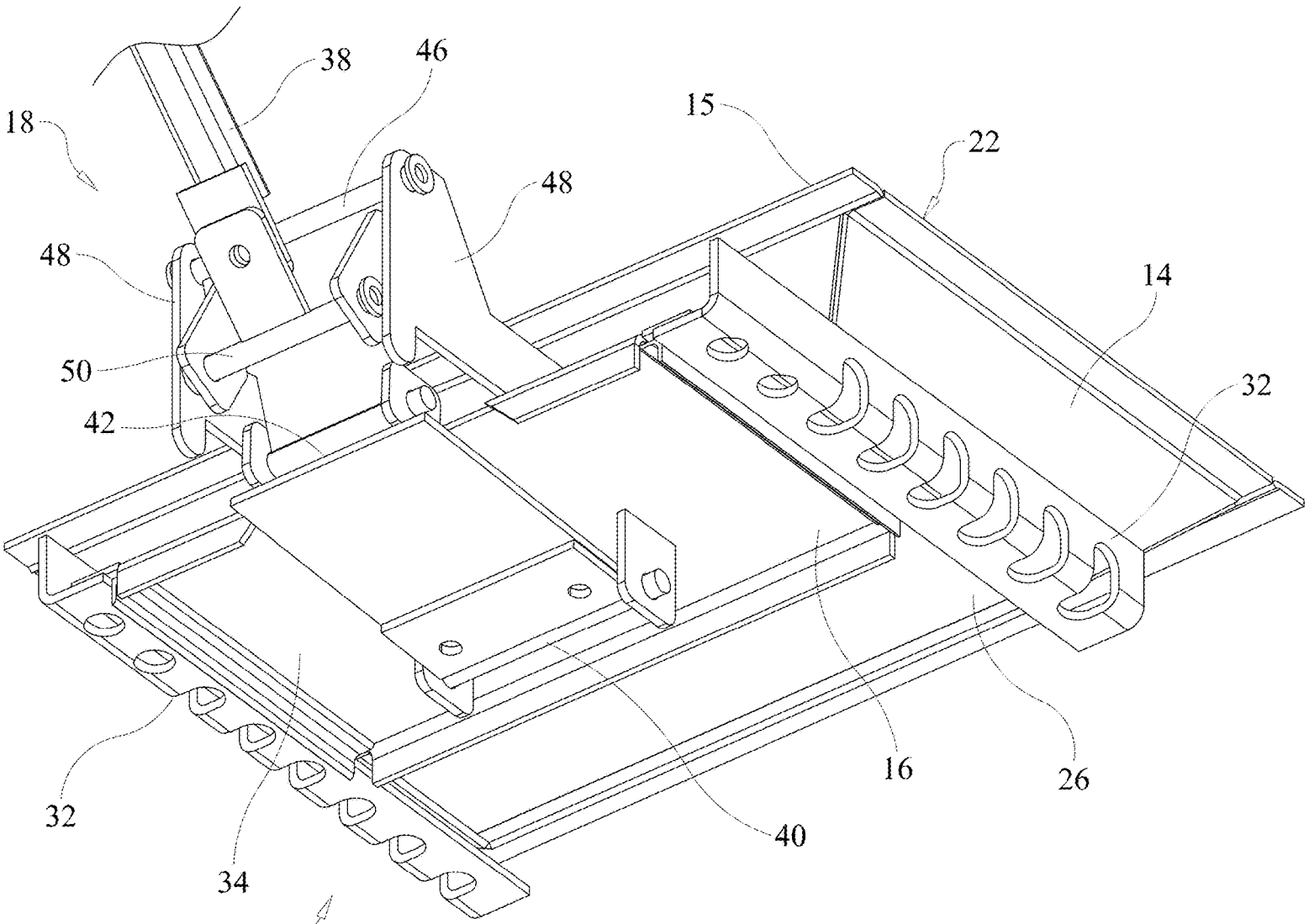
FIG. 4 illustrates another bottom perspective view of a slide gate closure, according to an aspect of the present disclosure.
Figure 5:
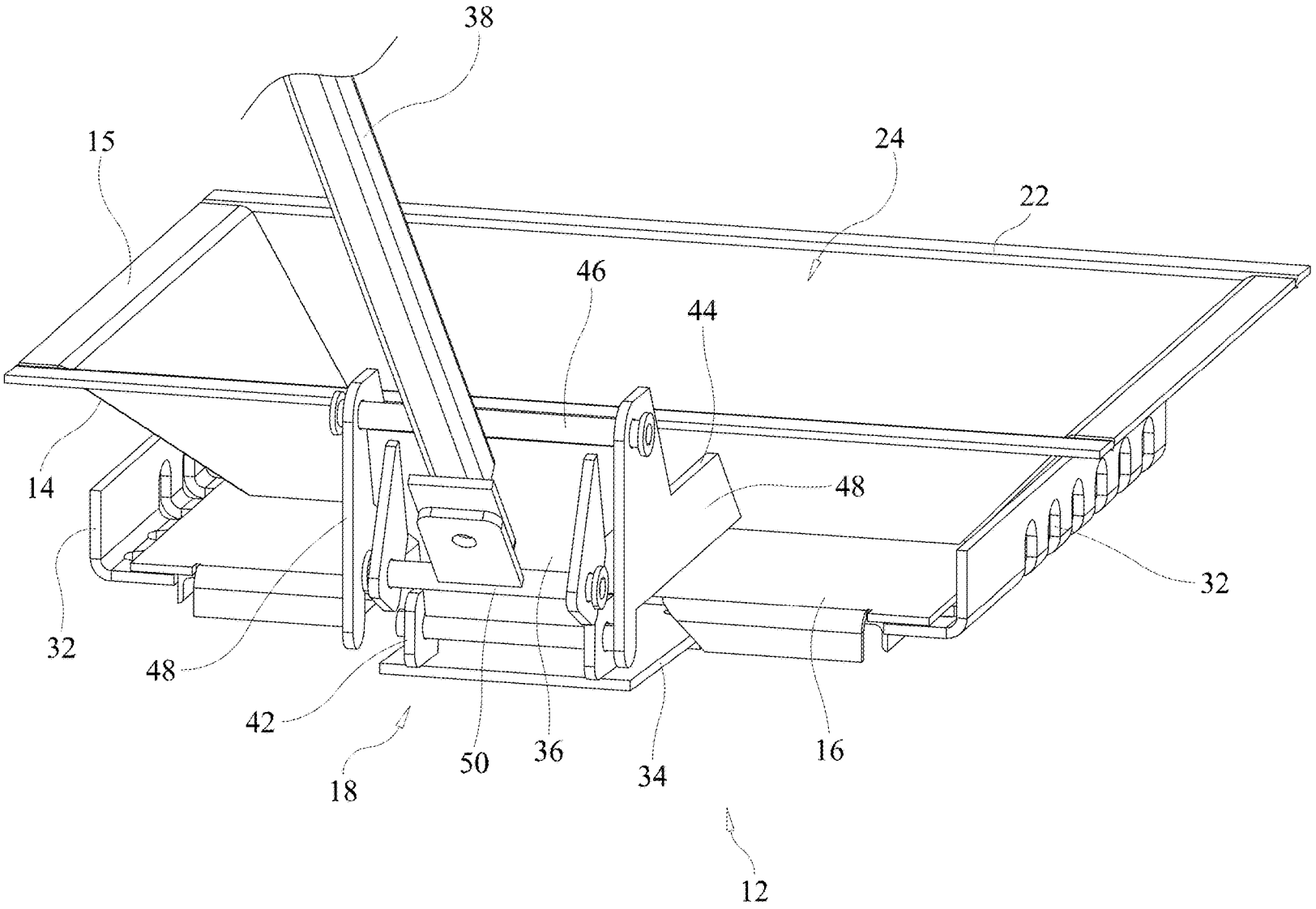
FIG. 5 illustrates a top perspective view of a slide gate closure, according to an aspect of the present disclosure.
Figure 6:
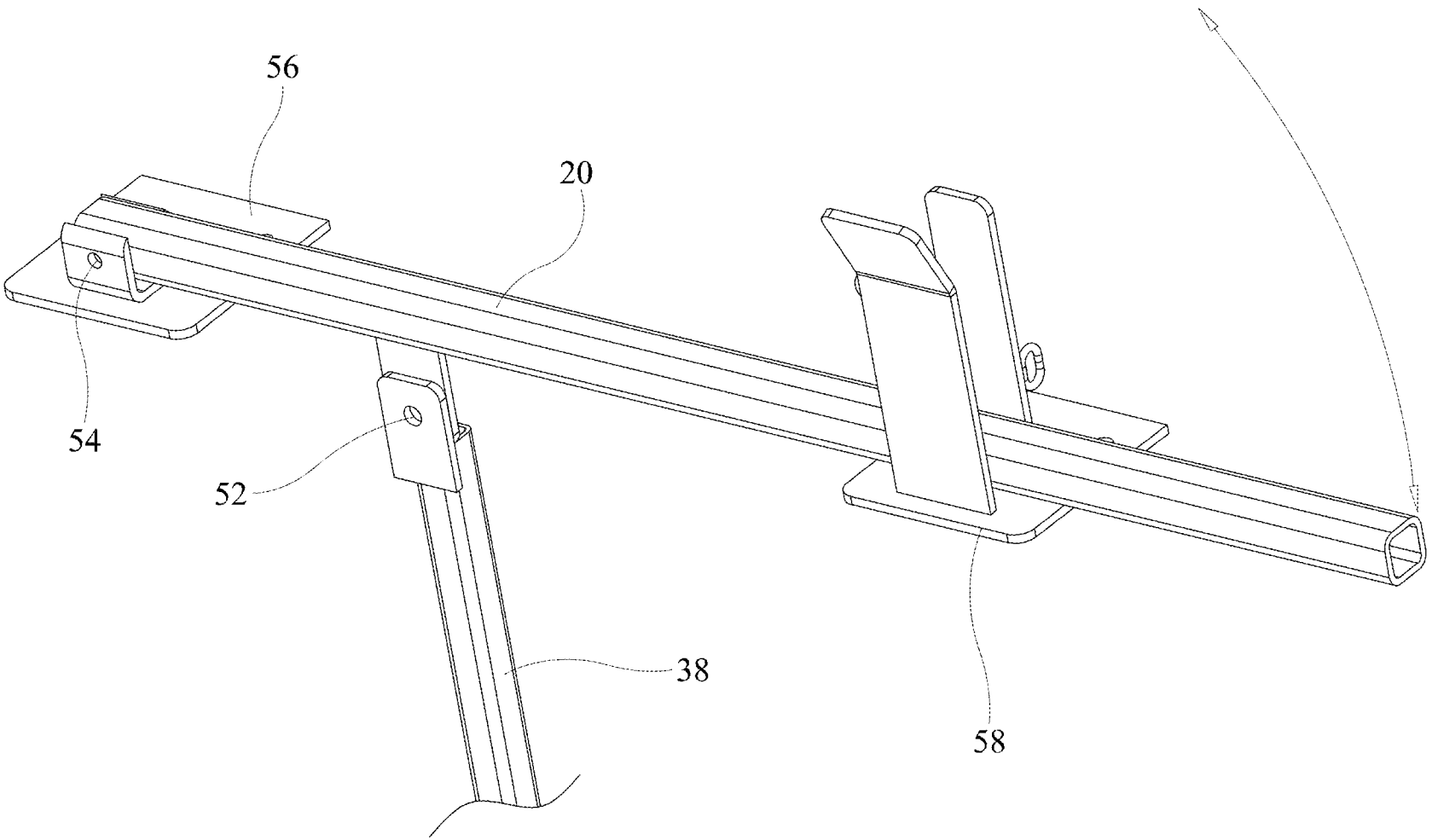
FIG. 6 illustrates a perspective view of a lever of a slide gate closure, according to an aspect of the present disclosure.
Figure 7:
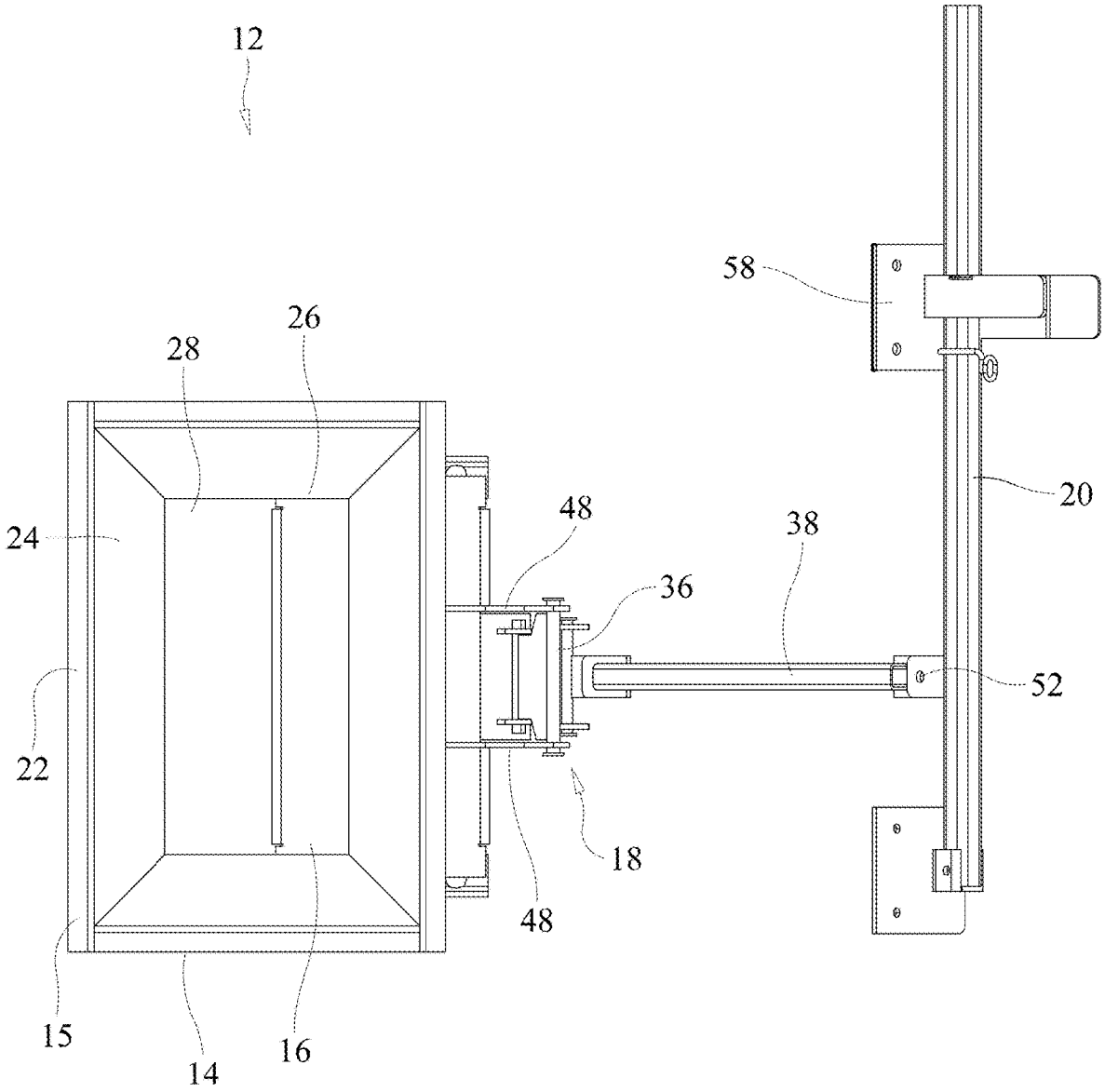
FIG. 7 illustrates a top view of a slide gate closure, according to an aspect of the present disclosure.
Figure 8:
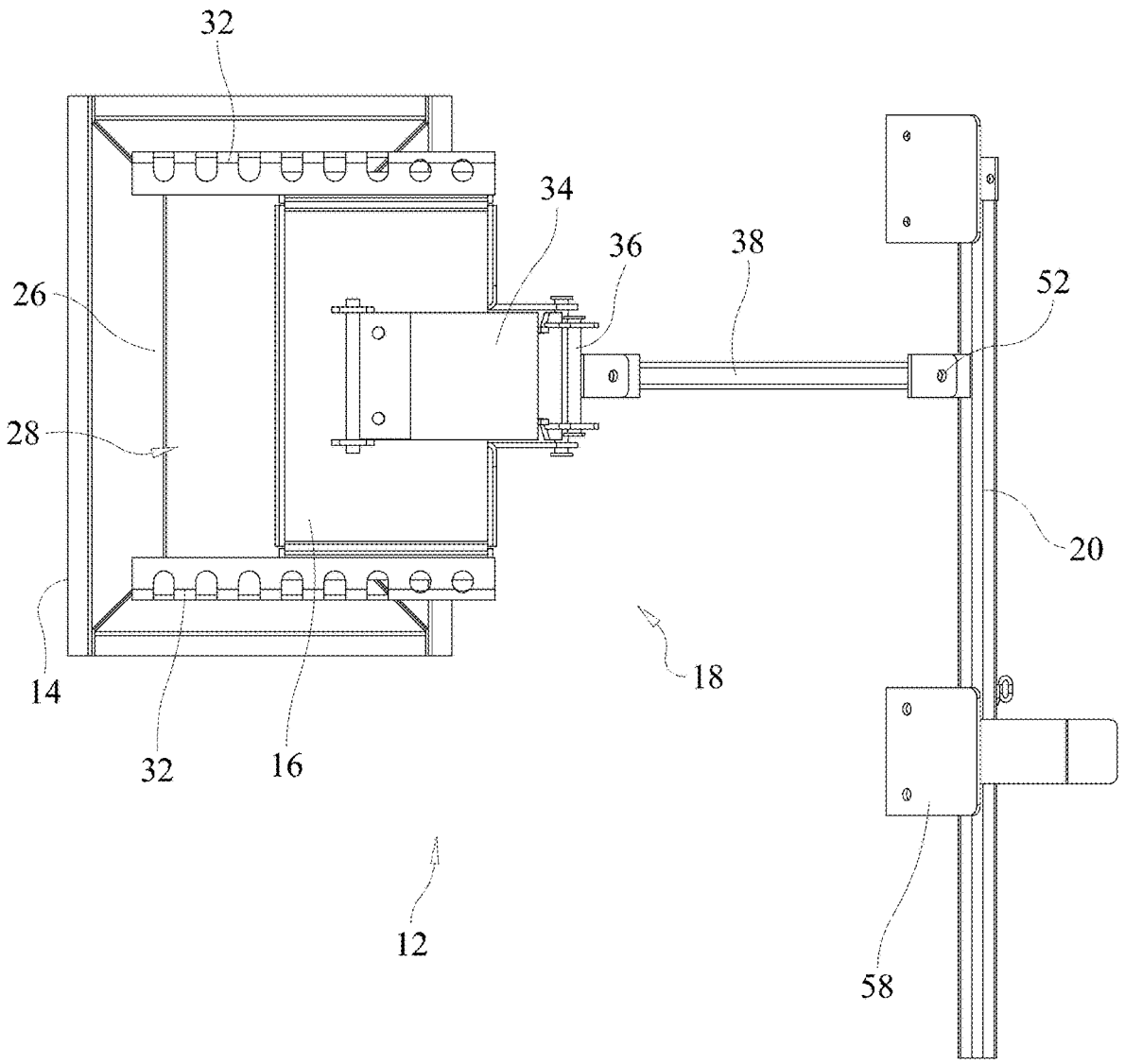
FIG. 8 illustrates a bottom view of a slide gate closure, according to an aspect of the present disclosure.

Referring to FIGS. 1 and 2 of the drawings, there is shown a conventional bottom discharge container 10 and a slide gate closure 12. Container 10 is representatively shown and may be any container, bin, hopper, or the like having a bottom discharge opening through which material that is held by the container may be dispensed. Closure 12 is attached to container 10 and operates to open and seal the discharge opening of the container to selectively dispense material held in the container.

With further reference to FIGS. 3-8, closure 12 has a frame 14, a slide gate 16, a slide gate linkage 18, and a lever 20. Frame 14 has an inlet side 22 that defines an inlet opening 24 and a discharge side 26, opposite of the inlet side, that defines an outlet opening 28. Frame 14 is mounted to the bottom of the container 10 with the inlet opening 24 aligned with the discharge opening 30 of the container so that material in the container can flow into the inlet opening and out of the outlet opening 28. Frame 14 may have a flange 15 around the inlet opening 24 to facilitate attaching the frame to the bottom of the container.

Frame 14 further has a pair of slide rails 32 located on opposite sides of the outlet opening 28. The slide rails 32 extend along the length of the outlet opening 28 and project outwardly from frame 14. Slide gate 16 is slidingly supported at opposite sides by slide rails 32 and is movable along the length of the slide rails between a closed position and an open position (the slide gate is shown partially open). In the closed position, the slide gate 16 is positioned across the outlet opening 24, thereby closing the opening and stopping material from flowing through the outlet opening. In the open position, slide gate 16 is positioned such that the outlet opening 24 is not obstructed by the slide gate, thereby allowing material to flow through the outlet opening.

Linkage 18 operatively connects slide gate 16 and lever 20 such that operating the lever causes the slide gate to slide along slide rails 32 to open and close the outlet opening 24. Linkage 18 has a first hinge plate 34, a second hinge plate 36, and a connecting rod 38. The first hinge plate 34 is generally flat in shape and is hingedly connected at one end to the bottom of slide gate 16 by hinge coupling 40. The opposite end of the first hinge plate 34 is hingedly connected to the second hinge plate 36 by hinge coupling 42 at one end of the second hinge plate. The opposite end of the second hinge plate 36 is hingedly connected to a supporting structure 44 by hinge coupling 46. Supporting structure 44 is fixed to frame 14. As shown, supporting structure 44 may include a pair of spaced flanges 48 that are fixedly connected to frame 14 and between which the second hinge plate 36 is disposed.

One end of the connecting rod 38 is hingedly connected to the second hinge plate 36. As shown, the connecting rod end is hingedly connected to the second hinge plate by hinge coupling 50 that extends between a pair of spaced tabs that extend outwardly from the second hinge plate. The opposite end of the connecting rod 38 is pivotally connected to the lever 20 at a location along its length by pivot coupling 52.

Lever 20 is pivotally attached at one end by pivot coupling 54, as shown, to a bracket or attachment structure 56 that may be attached to the container 10 or some other fixed structure. The opposite end may be secured in a latched position by latch 58 that may also be attached to the container 10 or some other fixed structure.

In operation, a user may lift upon lever 22 causing it to pivot about coupling 54 which pulls upwardly on the connecting rod 38 moving it in a direction away from frame 14. Such movement causes the second hinge plate 36 to rotate about hinge coupling 46 there by moving its opposite end in a direction away from frame 14. This movement is translated into the first hinge plate 34 causing it to also move in a direction away from the frame which in turn causes the slide gate 16 to move from a closed position to an open position. The slide gate 16 is moved from the open position to the closed position by lowering lever 22 which reverses the motion of the linkage causing the slide gate to move from the open position to the closed position.

The present invention may be embodied in other specific forms without departing from its spirit or essential characteristics. The embodiments described are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A slide gate closure for a bottom discharge bottom-discharge container having a discharge opening, the slide gate closure comprising:

a frame adapted to be mounted to a bottom of the container;

a slide gate slidably mounted to the frame such that the slide gate is configured to move selectively between a closed position, in which the slide gate fully covers the discharge opening, and an open position, in which the slide gate does not fully cover the discharge opening;

a lever;

a linkage operatively connecting the slide gate and the lever such that operating the lever in a first direction causes the slide gate to move in direction toward the open position and operating the lever in a second direction causes the slide gate to move in a direction toward the closed position; and the linkage having a first hinge plate and a second hinge plate, the first hinge plate pivotally connected the slide gate, and the second hinge plate pivotally connected to the first hinge plate, pivotally connected to frame, and operatively connected to the lever.

2. A slide gate closure for a bottom-discharge container having a discharge opening, the slide gate closure comprising:

a frame, the frame defining an inlet open on one side and defining an outlet opening on side opposite of the inlet opening, the frame adapted to be mounted to a bottom of the container with the inlet opening aligned with the discharge opening of the container;

the frame having a pair of slide rails located on opposite sides of the outlet opening;

a slide gate slidably supported at opposite sides thereof by the slide rails such that the slide gate is configured to move selectively between a closed position, in which the slide gate fully covers the discharge opening, and an open position, in which the slide gate does not fully cover the discharge opening;

a lever, the lever being pivotally mounted at one end thereof to a fixed structure and the opposite end of the lever being free such that the lever is rotatable relative to the fixed structure;

a linkage operatively connecting the slide gate and the lever such that rotating the lever in a first direction causes the slide gate to move in direction toward the open position and rotating the lever in a second direction causes the slide gate to move in a direction toward the closed position; and wherein the linkage has a connecting rod, a first hinge plate, and a second hinge operatively connecting the slide gate to the lever; and wherein the connecting rod is connected at one end thereof to the lever and connected at an opposite end to the second hinge plate the first hinge plate and the second hinge plate are connected for relative rotation therebetween, the first hinge plate is hingedly connected to the slide gate and is hingedly connected to the second hinge plate, and the second hinge plate is hingedly connected at one end to the frame and is further hingedly connected at a second end to the hinge plate.

3. The slide gate closure of claim 2, wherein the frame includes a supporting structure extending outwardly from a side of the frame and wherein the second hinge plate is hingedly connected to the supporting structure.

4. The slide gate closure of claim 3, wherein the supporting structure includes a pair of spaced apart flanges between which the second hinge plate is disposed.

5. A sliding gate closure for a bottom-discharge container having a sidewall and a bottom coupled to the sidewall, the bottom defining a discharge opening configured to permit material to exit the container, the slide gate closure, comprising:

a frame attached to the bottom of the bottom-discharge container;

a slide gate slidably mounted to the frame such that the slide gate is configured to move selectively between a closed position, in which the slide gate fully covers the discharge opening, and an open position, in which the slide gate does not fully cover the discharge opening;

a lever, the lever pivotally mounted to the sidewall of the bottom-discharge container;

a linkage operatively connecting the slide gate and the lever such that rotating the lever in a first direction causes the slide gate to move in a direction toward the open position and rotating the lever in a second direction causes the slide gate to move in a direction toward the closed position; and wherein the linkage has at a hinge plate, the hinge plate is operatively connected to the slide gate to pivot relative to the slide gate, is pivotally connected to the lever, and is pivotally connected to the frame.

6. The slide gate closure of claim 5, wherein the frame includes a supporting structure extending outwardly from a side of the frame and wherein the second hinge plate is hingedly connected to the supporting structure.

7. The slide gate closure of claim 6, wherein the supporting structure includes a pair of spaced apart flanges between which the second hinge plate is disposed.

8. The slide gate closure of claim 5, wherein the linkage further has a connecting rod that operatively connects the hinge plate and the lever.

9. The slide gate closure of claim 5, wherein the linkage further has connecting hinge plate that is pivotally connected to the first hinge plate and is pivotally connected to the slide gate.

10. The slide gate closure of claim 9, wherein the slide gate has an outward facing surface opposite an inward facing surface that faces the discharge opening, and the connecting hinge plate is pivotally connected to the outward facing surface.

* * * * *